US010274883B1

(12) United States Patent
Kuo et al.

(10) Patent No.: US 10,274,883 B1
(45) Date of Patent: Apr. 30, 2019

(54) CHARACTERIZING CROSS-TRACK SPACING VARIATIONS IN ELECTROPHOTOGRAPHIC PRINTER

(71) Applicant: Eastman Kodak Company, Rochester, NY (US)

(72) Inventors: Chung-Hui Kuo, Fairport, NY (US); Mark C. Zaretsky, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 15/887,080

(22) Filed: Feb. 2, 2018

(51) Int. Cl.
*G03G 15/00* (2006.01)
*G03G 15/01* (2006.01)

(52) U.S. Cl.
CPC ..... *G03G 15/5058* (2013.01); *G03G 15/01* (2013.01); *G03G 15/5062* (2013.01)

(58) Field of Classification Search
CPC ..... G03G 15/01; G03G 15/5054; G03G 15/5058; G03G 15/5062
See application file for complete search history.

(56) References Cited

U.S. PATENT DOCUMENTS 5,510,896 A 4/1996 Wafler
6,666,542 B2 12/2003 Yoshiyama et al.
6,879,973 B2 4/2005 Skaanning et al.
8,150,106 B2 4/2012 Wu et al.
8,570,601 B2 10/2013 Skinner et al.
9,114,650 B2 8/2015 Raz et al.
9,233,568 B1 1/2016 Mizes et al.
9,712,712 B1 7/2017 Kuo et al.
9,772,576 B1 9/2017 Dobbertin et al.
2009/0092408 A1* 4/2009 Mizes ..... G03G 15/5062 399/49
2010/0135702 A1* 6/2010 Calamita ..... G03G 15/0194 399/301
2012/0251141 A1* 10/2012 Henderson ..... G03G 15/5029 399/49
2013/0155422 A1* 6/2013 Kuo ..... H04N 1/506 358/1.2

* cited by examiner

*Primary Examiner* — Carla J Therrien
(74) *Attorney, Agent, or Firm* — Kevin E. Spaulding

(57) ABSTRACT

Cross-track spacing variations for a plurality of printer subsystems of an electrophotographic printing system are characterized by printing first and second test pattern and capturing image of the printed test patterns. The first and second test patterns are chosen so that the printed test patterns respond differently to cross-track spacing variations in different printer subsystems. The first and second digitized test patterns are analyzed to determine parameters that characterize an attribute of the printed test pattern as a function of cross-track position. A first defect model is used to determine estimated cross-track spacing variations for one or more printer subsystem as a function of the determined parameters.

19 Claims, 12 Drawing Sheets

CHARACTERIZING CROSS-TRACK SPACING VARIATIONS IN ELECTROPHOTOGRAPHIC PRINTER

FIELD OF THE INVENTION

This invention pertains to the field of electrographic printing and more particularly to a method for characterizing cross-track spacing variations for printer subsystems of an electrophotographic printing system.

BACKGROUND OF THE INVENTION

Electrophotography is a useful process for printing images on a receiver (or "imaging substrate"), such as a piece or sheet of paper or another planar medium (e.g., glass, fabric, metal, or other objects) as will be described below. In this process, an electrostatic latent image is formed on a photoreceptor by uniformly charging the photoreceptor and then discharging selected areas of the uniform charge to yield an electrostatic charge pattern corresponding to the desired image (i.e., a "latent image").

After the latent image is formed, charged toner particles are brought into the vicinity of the photoreceptor and are attracted to the latent image to develop the latent image into a toner image. Note that the toner image may not be visible to the naked eye depending on the composition of the toner particles (e.g., clear toner).

After the latent image is developed into a toner image on the photoreceptor, a suitable receiver is brought into juxtaposition with the toner image. A suitable electric field is applied to transfer the toner particles of the toner image to the receiver to form the desired print image on the receiver. The imaging process is typically repeated many times with reusable photoreceptors.

The receiver is then removed from its operative association with the photoreceptor and subjected to heat or pressure to permanently fix (i.e., "fuse") the print image to the receiver. Plural print images (e.g., separation images of different colors) can be overlaid on the receiver before fusing to form a multicolor print image on the receiver.

One problem that can occur in electrophotographic printing systems is that cross-track spacing variations can occur for various components. Such cross-track spacing variations are sometimes called "skew." For example, the spacing between the charging subsystem and the surface of the photoreceptor can vary across the cross-track width of the photoreceptor. This can produce a gradient in the charge on the photoreceptor produced by the charging system, which can in turn produce non-uniformities in the printed images. Other subsystems such as the exposure subsystem and development subsystem can also be susceptible to image quality variations due to cross-track spacing variations. Such cross-track spacing variations can be difficult to detect and correct. For example, if a cross-track density gradation is detected in a uniform region of a printed image is observed, it can be difficult to troubleshoot which subsystem may have a cross-track spacing variation that is causing the artifact. This is particularly true for systems that are deployed at a customer location where specialized equipment may be unavailable.

There remains a need for a method to reliably troubleshoot and characterize cross-track spacing variations in an electrophotographic printing system that can be performed without the need for specialized equipment.

SUMMARY OF THE INVENTION

The present invention represents a method for characterizing cross-track spacing variations for a plurality of printer subsystems of an electrophotographic printing system, includes:

printing a first test pattern;

printing a second test pattern;

capturing an image of the printed first test pattern to provide a first digitized test pattern including a first array of pixel values;

capturing an image of the printed second test pattern to provide a second digitized test pattern including a second array of pixel values;

analyzing the first digitized test pattern to determine a first set of parameters that characterize an attribute of the printed first test pattern as a function of cross-track position;

analyzing the digitized second digitized test pattern to determine a second set of parameters that characterize an attribute of the printed second test pattern as a function of cross-track position; and using a first defect model to determine an estimated first cross-track spacing variation for a first printer subsystem as a function of the determined first set of parameters and the determined second set of parameters.

This invention has the advantage that cross-track spacing variations in various printer subsystems can be characterized conveniently by printing and evaluating appropriate test patterns without the need to make physical measurements.

It has the additional advantage that the method can be performed by an unskilled system operator without the need for specialized equipment.

It has the further advantage that the detected cross-track spacing variations can be manually or automatically corrected to provide improved image quality.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
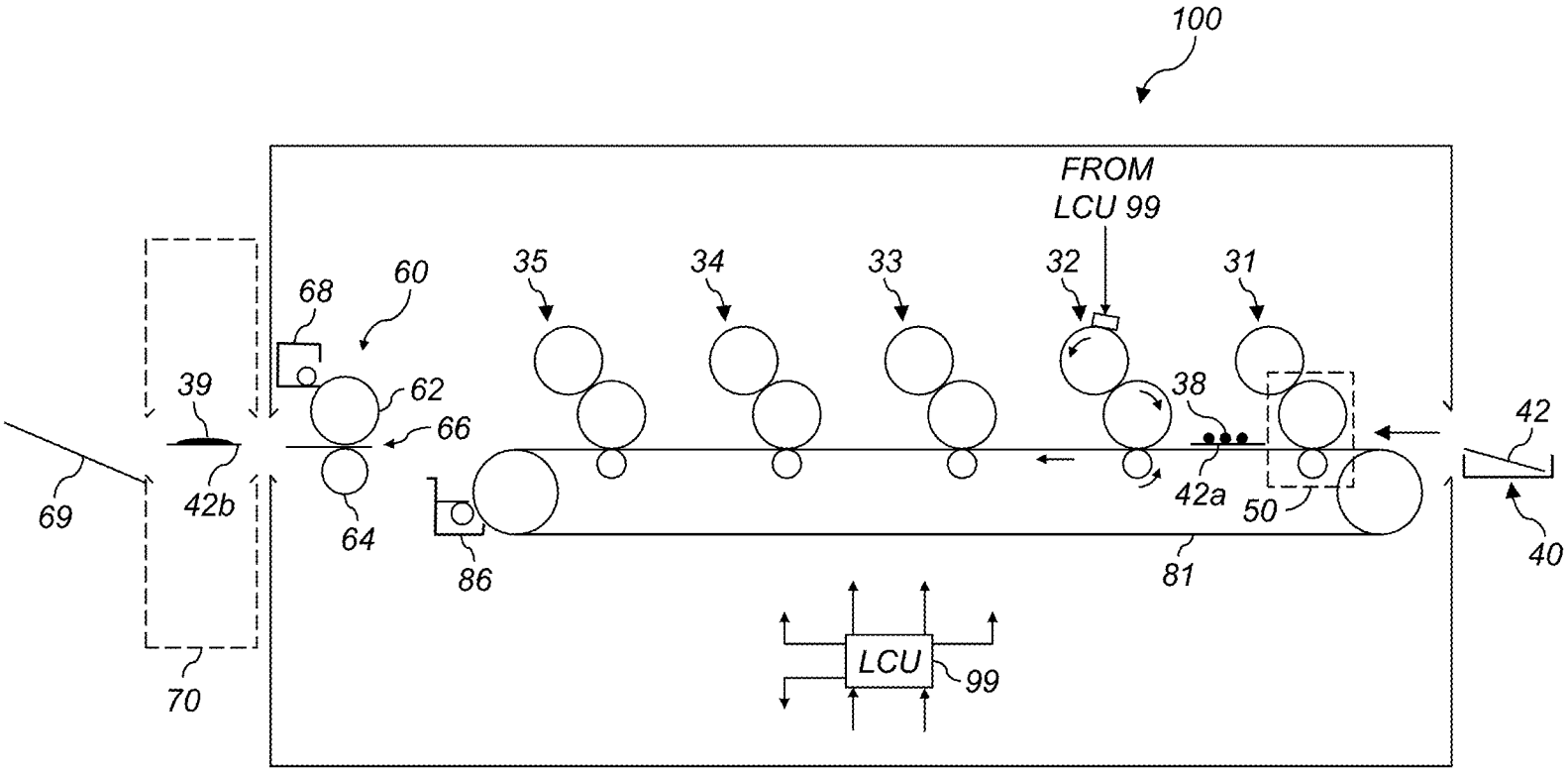
FIG. 1 (Prior Art)
FIG. 1 is an cross-sectional view of an electrophotographic printer suitable for use with various embodiments.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated, or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

As used herein, the terms "parallel" and "perpendicular" have a tolerance of ±10°.

As used herein, "sheet" is a discrete piece of media, such as receiver media for an electrophotographic printer (described below). Sheets have a length and a width. Sheets are folded along fold axes (e.g., positioned in the center of the sheet in the length dimension, and extending the full width of the sheet). The folded sheet contains two "leaves," each leaf being that portion of the sheet on one side of the fold axis. The two sides of each leaf are referred to as "pages." "Face" refers to one side of the sheet, whether before or after folding.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters (e.g., less than 8 μm, on the order of 10-15 μm, up to approximately 30 μm, or larger), where "diameter" preferably refers to the volume-weighted median diameter, as determined by a device such as a Coulter Multisizer.

"Toner" refers to a material or mixture that contains toner particles, and that can be used to form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

As mentioned already, toner includes toner particles; it can also include other types of particles. The particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remanence, florescence, resistance to etchants, and other properties of additives known in the art.

In single-component or mono-component development systems, "developer" refers to toner alone. In these systems, none, some, or all of the particles in the toner can themselves be magnetic. However, developer in a mono-component system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles (e.g., 15-20 μm or 20-300 μm in diameter). A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields). The present invention can be practiced using any type of electrographic printing system, including electrophotographic and ionographic printers.

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color images onto a receiver. A printer can also produce selected patterns of toner on a receiver, which patterns (e.g., surface textures) do not correspond directly to a visible image.

The DFE receives input electronic files (such as Postscript command files) composed of images from other input devices (e.g., a scanner, a digital camera or a computer-generated image processor). Within the context of the present invention, images can include photographic renditions of scenes, as well as other types of visual content such as text or graphical elements. Images can also include invisible content such as specifications of texture, gloss or protective coating patterns.

The DFE can include various function processors, such as a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system that accounts for characteristics of the image printing process implemented in the print engine (e.g., the electrophotographic process) to provide known, consistent color reproduction characteristics. The color management system can also provide known color reproduction for different inputs (e.g., digital camera images or film images). Color management systems are well-known in the art, and any such system can be used to provide color corrections in accordance with the present invention.

In an embodiment of an electrophotographic modular printing machine useful with various embodiments (e.g., the NEXPRESS SX 3900 printer manufactured by Eastman Kodak Company of Rochester, N.Y.) color-toner print images are made in a plurality of color imaging modules arranged in tandem, and the print images are successively electrostatically transferred to a receiver adhered to a transport web moving through the modules. Colored toners include colorants, (e.g., dyes or pigments) which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image. In other electrophotographic printers, each visible image is transferred sequentially onto an intermediate member such as an endless belt or cylinder and then the final, multilayered image is transferred to the receiver.

Electrophotographic printers having the capability to also deposit clear toner using an additional imaging module are also known. The provision of a clear-toner overcoat to a color print is desirable for providing features such as protecting the print from fingerprints, reducing certain visual artifacts or providing desired texture or surface finish characteristics. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
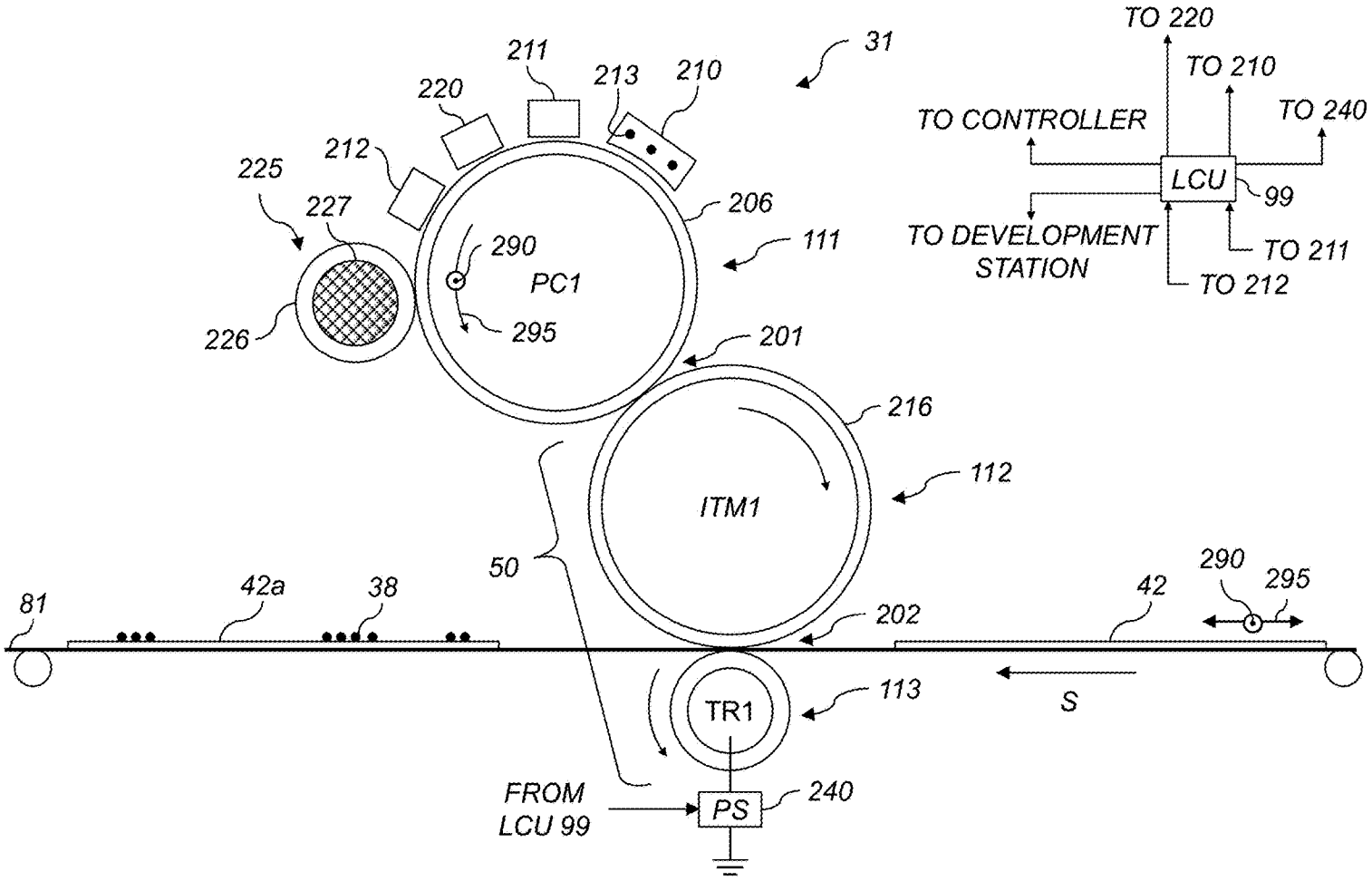
FIG. 2 (Prior Art)
FIG. 2 is an cross-sectional view of one printing module of the electrophotographic printer of FIG. 1.

FIGS. 1-2 are elevational cross-sections showing portions of a typical electrophotographic printer 100 useful with various embodiments. Printer 100 is adapted to produce images, such as single-color images (i.e., monochrome images), or multicolor images such as CMYK, or pentachrome (five-color) images, on a receiver. Multicolor images are also known as "multi-component" images. One embodiment involves printing using an electrophotographic print engine having five sets of single-color image-producing or image-printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. In some embodiments one or more of the printing module 31, 32, 33, 34, 35 can print a colorless toner image, which can be used to provide a protective overcoat or tactile image features. Receiver 42 is transported from supply unit 40, which can include active feeding subsystems as known in the art, into printer 100 using a transport web 81. In various embodiments, the visible image can be transferred directly from an imaging roller to a receiver, or from an imaging roller to one or more transfer roller(s) or belt(s) in sequence in transfer subsystem 50, and then to receiver 42. Receiver 42 is, for example, a selected section of a web or a cut sheet of a planar receiver media such as paper or transparency film.

In the illustrated embodiments, each receiver 42 can have up to five single-color toner images transferred in registration thereon during a single pass through the five printing modules 31, 32, 33, 34, 35 to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an exemplary embodiment, printing module 31 forms black (K) print images, printing module 32 forms yellow (Y) print images, printing module 33 forms magenta (M) print images, and printing module 34 forms cyan (C) print images.

Printing module 35 can form a red, blue, green, or other fifth print image, including an image formed from a clear toner (e.g., one lacking pigment). The four subtractive primary colors, cyan, magenta, yellow, and black, can be combined in various combinations of subsets thereof to form a representative spectrum of colors. The color gamut of a printer (i.e., the range of colors that can be produced by the printer) is dependent upon the materials used and the process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42*a* is shown after passing through printing module 31. Print image 38 on receiver 42*a* includes unfused toner particles. Subsequent to transfer of the respective print images, overlaid in registration, one from each of the respective printing modules 31, 32, 33, 34, 35, receiver 42*a* is advanced to a fuser module 60 (i.e., a fusing or fixing assembly) to fuse the print image 38 to the receiver 42*a*. Transport web 81 transports the print-image-carrying receivers to the fuser module 60, which fixes the toner particles to the respective receivers, generally by the application of heat and pressure. The receivers are serially de-tacked from the transport web 81 to permit them to feed cleanly into the fuser module 60. The transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along the transport web 81 before or after cleaning station 86 in the direction of rotation of transport web 81.

In the illustrated embodiment, the fuser module 60 includes a heated fusing roller 62 and an opposing pressure roller 64 that form a fusing nip 66 therebetween. In an embodiment, fuser module 60 also includes a release fluid application substation 68 that applies release fluid, e.g., silicone oil, to fusing roller 62. Alternatively, wax-containing toner can be used without applying release fluid to the fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The fused receivers (e.g., receiver 42*b* carrying fused image 39) are transported in series from the fuser module 60 along a path either to an output tray 69, or back to printing modules 31, 32, 33, 34, 35 to form an image on the backside of the receiver (i.e., to form a duplex print). Receivers 42*b* can also be transported to any suitable output accessory. For example, an auxiliary fuser or glossing assembly can provide a clear-toner overcoat. Printer 100 can also include multiple fuser modules 60 to support applications such as overprinting, as known in the art.

In various embodiments, between the fuser module 60 and the output tray 69, receiver 42*b* passes through a finisher 70. Finisher 70 performs various paper-handling operations, such as folding, stapling, saddle-stitching, collating, and binding.

Printer 100 includes main printer apparatus logic and control unit (LCU) 99, which receives input signals from various sensors associated with printer 100 and sends control signals to various components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. In some embodiments, sensors associated with the fuser module 60 provide appropriate signals to the LCU 99. In response to the sensor signals, the LCU 99 issues command and control signals that adjust the heat or pressure within fusing nip 66 and other operating parameters of fuser module 60. This permits printer 100 to print on receivers of various thicknesses and surface finishes, such as glossy or matte.

Image data for printing by printer 100 can be processed by a raster image processor (RIP; not shown), which can include a color separation screen generator or generators. The output of the RIP can be stored in frame or line buffers for transmission of the color separation print data to each of a set of respective LED writers associated with the printing modules 31, 32, 33, 34, 35 (e.g., for black (K), yellow (Y), magenta (M), cyan (C), and red (R) color channels, respectively). The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes (e.g., color correction) in order to obtain the desired color print. Color image data is separated into the respective colors and converted by the RIP to halftone dot image data in the respective color (for example, using halftone matrices, which provide desired screen angles and screen rulings). The RIP can be a suitably-programmed computer or logic device and is adapted to employ stored or computed halftone matrices and templates for processing separated color image data into rendered image data in the form of halftone information suitable for printing. These halftone matrices can be stored in a screen pattern memory.

FIG. 2 shows additional details of printing module 31, which is representative of printing modules 32, 33, 34, and 35 (FIG. 1). Photoreceptor 206 of imaging member 111 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors 206 can also contain multiple layers.

In-track direction 295 refers to the direction of motion of the receiver 42 and the image-bearing components (e.g., photoreceptor 206 and surface 216), and cross-track direction 290 refers to the direction which spans the width of the components which will be perpendicular to in-track direction and to the plane of FIG. 2.

Charging subsystem 210 applies a uniform electrostatic charge to photoreceptor 206 of imaging member 111. In an exemplary embodiment, charging subsystem 210 includes a set of one or more wires 213 operated at a high voltage (DC, AC or some combination of the two) to create and deposit electrostatic charge on the surface of the photoreceptor 206. Additional necessary components provided for control can be assembled about the various process elements of the respective printing modules. Meter 211 measures the uniform electrostatic charge provided by charging subsystem 210.

An exposure subsystem 220 is provided for selectively modulating the uniform electrostatic charge on photoreceptor 206 in an image-wise fashion by exposing photoreceptor 206 to electromagnetic radiation to form a latent electrostatic image. The uniformly-charged photoreceptor 206 is typically exposed to actinic radiation provided by selectively activating particular light sources in an LED array or a laser device outputting light directed onto photoreceptor 206. In embodiments using laser devices, a rotating polygon (not shown) is sometimes used to scan one or more laser beam(s) across the photoreceptor in the fast-scan direction. One pixel site is exposed at a time, and the intensity or duty cycle of the laser beam is varied at each pixel site. In embodiments using an LED array, the array can include a plurality of LEDs arranged next to each other in a line, all pixel sites in one row of pixel sites on the photoreceptor can be selectively exposed simultaneously, and the intensity or duty cycle of each LED can be varied within a line exposure time to expose each pixel site in the row during that line exposure time.

As used herein, an "engine pixel" is the smallest addressable unit on photoreceptor 206 which the exposure subsystem 220 (e.g., the laser or the LED) can expose with a selected exposure different from the exposure of another engine pixel. Engine pixels can overlap (e.g., to increase addressability in the slow-scan direction). Each engine pixel has a corresponding engine pixel location, and the exposure applied to the engine pixel location is described by an engine pixel level.

The exposure subsystem 220 can be a write-white or write-black system. In a write-white or "charged-area-development" system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or "discharged-area development" system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

In the illustrated embodiment, meter 212 is provided to measure the post-exposure surface potential within a patch area of a latent image formed from time to time in a non-image area on photoreceptor 206. Other meters and components can also be included (not shown).

A development station 225 includes toning shell 226, which can be rotating or stationary, for applying toner of a selected color to the latent image on photoreceptor 206 to produce a developed image on photoreceptor 206 corresponding to the color of toner deposited at this printing module 31. Development station 225 is electrically biased by a suitable respective voltage to develop the respective latent image, which voltage can be supplied by a power supply (not shown). Developer is provided to toning shell 226 by a supply system (not shown) such as a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In some embodiments, the development station 225 employs a two-component developer that includes toner particles and magnetic carrier particles. The exemplary development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Development station 225 can also employ a mono-component developer comprising toner, either magnetic or non-magnetic, without separate magnetic carrier particles.

Transfer subsystem 50 includes transfer backup member 113, and intermediate transfer member 112 for transferring the respective print image from photoreceptor 206 of imaging member 111 through a first transfer nip 201 to surface 216 of intermediate transfer member 112 (which is biased by a power source), and thence to a receiver 42 which receives respective toned print images 38 from each printing module in superposition to form a composite image thereon. The print image 38 is, for example, a separation of one color, such as cyan. Receiver 42 is transported by transport web 81. Transfer to a receiver is effected by an electrical field provided to transfer backup member 113 by power source 240, which is controlled by LCU 99. Receiver 42 can be any object or surface onto which toner can be transferred from imaging member 111 by application of the electric field. In this example, receiver 42 is shown prior to entry into a second transfer nip 202, and receiver 42*a* is shown subsequent to transfer of the print image 38 onto receiver 42*a*.

In the illustrated embodiment, the toner image is transferred from the photoreceptor 206 to the intermediate transfer member 112, and from there to the receiver 42. Registration of the separate toner images is achieved by registering the separate toner images on the receiver 42, as is done with the NEXPRESS SX 3900. In some embodiments, a single transfer member is used to sequentially transfer toner images from each color channel to the receiver 42. In other embodiments, the separate toner images can be transferred in register directly from the photoreceptor 206 in the respective printing module 31, 32, 33, 34, 25 to the receiver 42 without using a transfer member. Either transfer process is suitable when practicing this invention. An alternative method of transferring toner images involves transferring the separate toner images, in register, to a transfer member and then transferring the registered image to a receiver.

LCU 99 sends control signals to the charging subsystem 210, the exposure subsystem 220, and the respective development station 225 of each printing module 31, 32, 33, 34, 35 (FIG. 1), among other components. Each printing module can also have its own respective controller (not shown) coupled to LCU 99.

As discussed earlier, a problem that can occur in electrophotographic printing modules 31 is that cross-track spacing variations (i.e., skew) can occur for various components such as the charging subsystem 210, the exposure subsystem 220 and the development subsystem 225. For example, the spacing between the charging subsystem 210 and the surface of the photoreceptor 206 can vary across the cross-track width of the imaging member 111 (e.g., the spacing can be smaller at one end of the charging subsystem 210 than at the other end). This can produce a gradient in the charge on the photoreceptor 206 produced by the charging system 210, which can in turn produce non-uniformities in the printed images. Cross-track variations may also occur due to individual components within a subsystem. For example, within the development subsystem 225 there is typically a metering skive controlling the amount of developer loading onto a toning roller. If this skive is not set parallel to the toning roller then there will be a variation in developer thickness (and toner mass flow rate) on the toning roller. This can also be a source of cross-track density variations. The various types of cross-track spacing variations can be difficult to detect and correct. For example, if a cross-track density gradation is detected in a uniform region of a printed image is observed, it can be difficult to troubleshoot which subsystem may have a cross-track spacing variation that is causing the artifact.

Inventors have discovered that different types of test patterns have different sensitivities to cross-track spacing variations of different subsystems. Inventors have developed a method to leverage these sensitivity differences to diagnose which subsystem(s) are misaligned and to estimate the magnitude the cross-track spacing variations. The method can be conveniently performed without the need for specialized equipment so that it can be easily performed by unskilled operators at a customer site.

Aspects of the present invention will now be described with reference to FIG. 3, which shows a flow chart of an exemplary embodiment. The method is based on printing a plurality of different test patterns that respond differently to cross-track spacing variations in different subsystems of an electrophotographic printing module 31. In an exemplary embodiment, the method uses two different test patterns (first test pattern 300 and second test pattern 305). However, in other embodiment more than two different types of test patterns can be used. In an exemplary embodiment, the first and second test patterns 300 use different types of halftone patterns (e.g., conventional halftone dot screen and a line screen).

Figure 4:
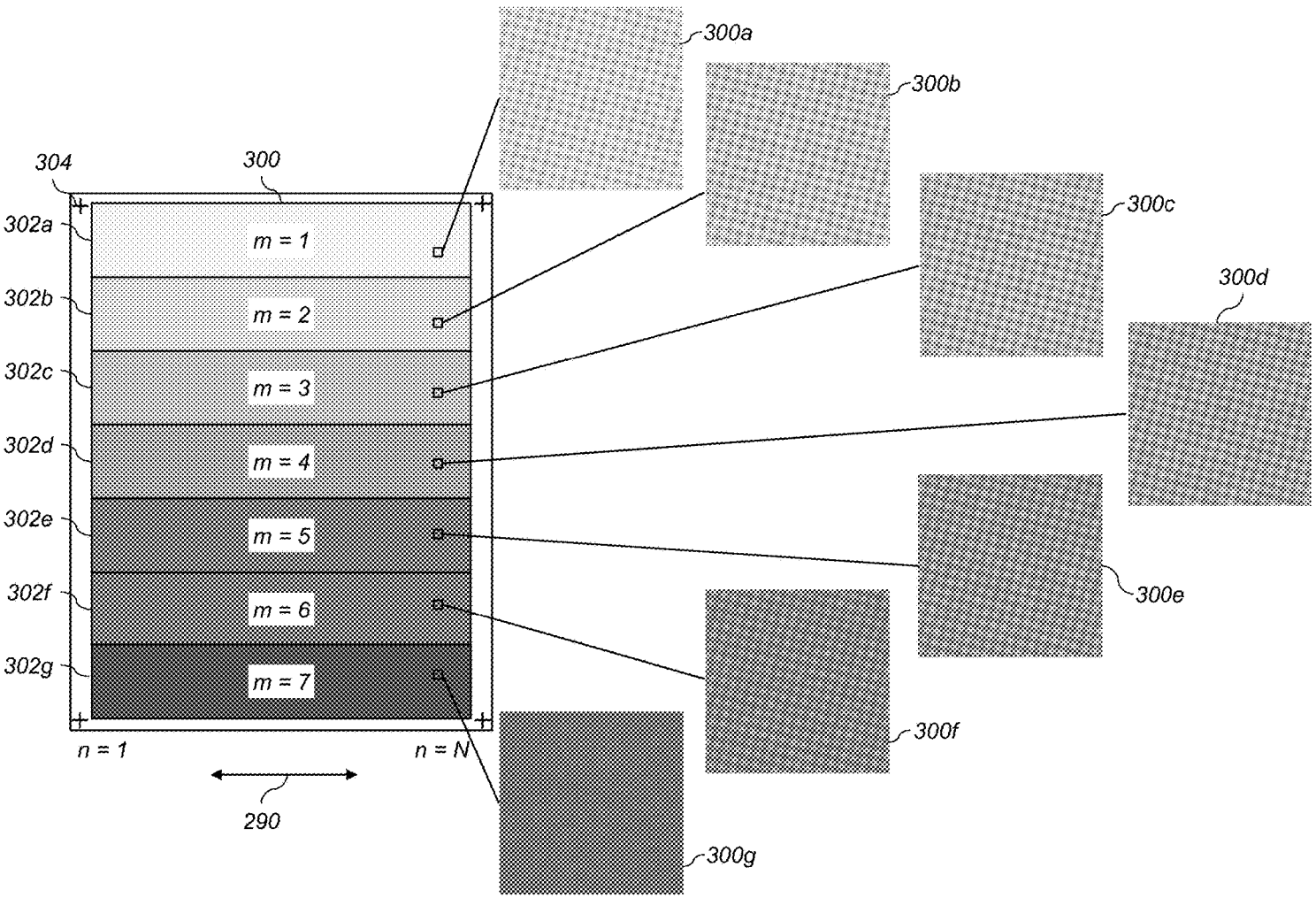
FIGS. 4 and 5 illustrate test patterns that can be used to perform the method of FIG. 3.

FIG. 4 shows an exemplary first test pattern 300 having a series of uniform tone level regions 302*a*-302*g* spanning the width of the media in the cross-track direction 290. Each of the regions 302*a*-302*g* has a different tone level produced by a corresponding region test pattern 300*a*-300*g*. (The illustrated region test patterns 300*a*-300*g* in FIG. 4 are scans of a printed first test pattern 300.) The illustrated first test pattern 300 also includes fiducial marks 304 to aid in determining the locations of the regions 302*a*-302*g* in scans of the printed test target.

In the illustrated example, the region test patterns 300*a*-300*g* are classic halftone dot patterns as illustrated in the enlarged insets. The halftone dot patterns vary from a light region test pattern 300*a* having a small dot size in region 302*a* to a dark region test pattern 300*g* having a large dot size in region 302*g*. In the illustrated example there are seven regions, where m is the region number, which ranges from m=1 to m=7. The halftone dot patterns can be formed using any method known in the art. In some embodiments, the first test pattern 300 is a halftoned image which is predetermined and stored in a digital memory. In a preferred embodiment, the first test pattern 300 is determined at the time of printing by running a stored continuous tone image file through an image processing system that applies an appropriate halftoning algorithm. The different dot sizes associated with the different image regions can be formed using a variety of different methods. For example, the dot size can be varied by controlling the number of image pixels that make up the halftone dots or by controlling the exposure level provided to the image pixels that make up the halftone dots. Controlling the exposure level will control the charge on the photoconductor and thereby control the amount of developed toner, resulting in different pixel optical density levels and different average tone values. In a preferred embodiment, the dot size is varied by controlling both the number of image pixels in the halftone dot and the exposure level provided to those image pixels. Such halftoning methods are well-known and conventional in electrophotographic printing systems.

As will be discussed later, the printed test patterns are digitized to provide digitized test patterns which are sampled at a set of cross-track positions. In the figure, the cross-track position is given by a variable n, which ranges from n=1 to n=N. In an exemplary embodiment, N=12,800. In other embodiments, the value of N could be smaller or larger, but should preferably be at least 3, and more preferably 10.

Figure 5:
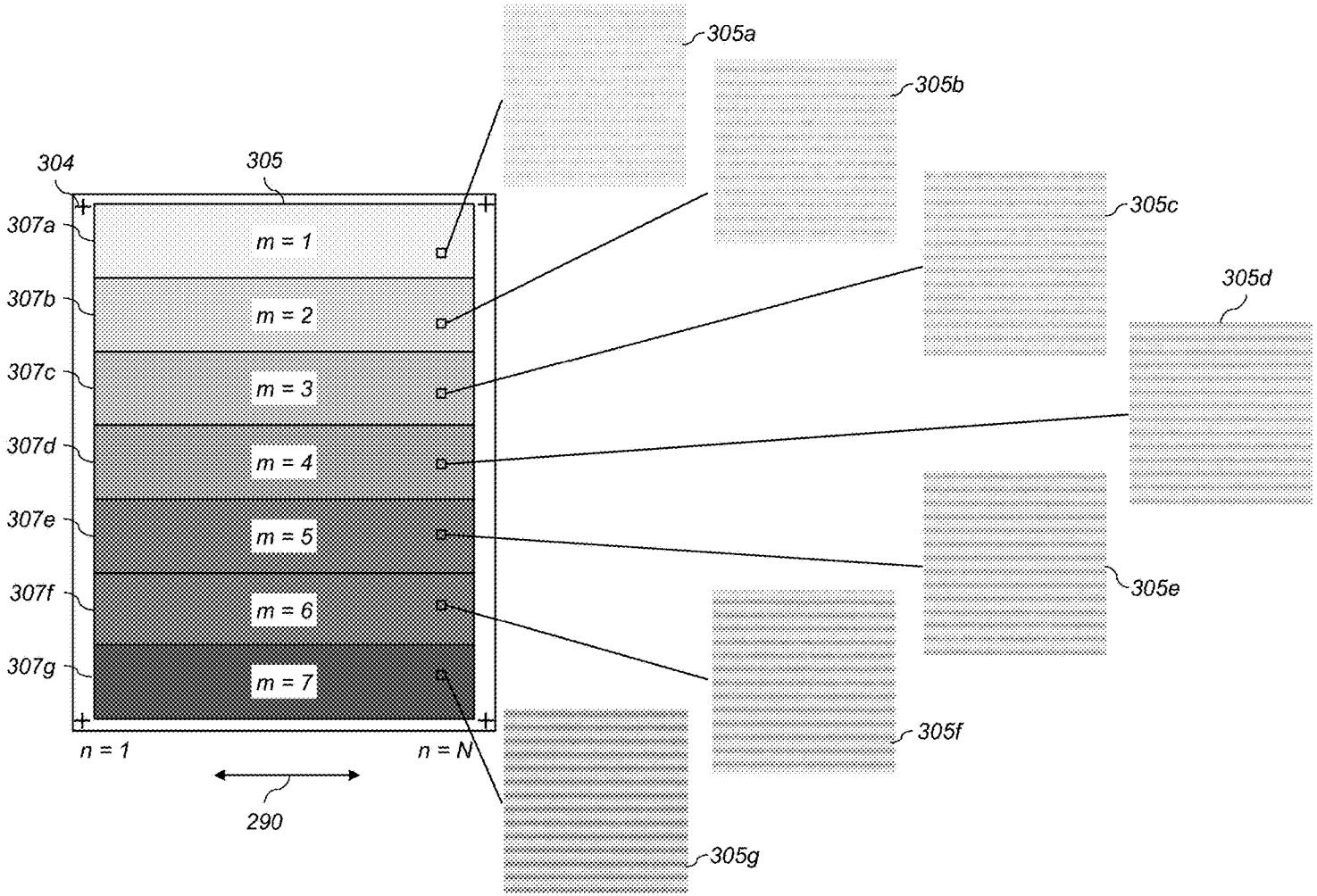

FIG. 5 shows an exemplary second test pattern 305 having a series of uniform tone level regions 307*a*-307*g* spanning the width of the media in the cross-track direction 290. Each of the regions 307*a*-307*g* has a different tone level produced by a corresponding region test pattern 305*a*-305*g*. In this example, the region test patterns 305*a*-305*g* are vertical line screen patterns as illustrated in the enlarged insets, where each region has a different line density and line width. In some embodiments, the second test pattern 305 is a line screened image which is predetermined and stored in a digital memory. In a preferred embodiment, the second test pattern 305 is determined at the time of printing by running a stored continuous tone image file through an image processing system that applies an appropriate line screen halftoning algorithm. The different line widths associated with the different image regions can be formed using a variety of different methods. For example, the line width can be varied by controlling the number of image pixels across the width of the lines or by controlling the exposure level provided to the image pixels that make up the lines. In a preferred embodiment, the lines are a single pixel wide and the line density/line width is varied by controlling the exposure level provided to those image pixels.

Figure 3:
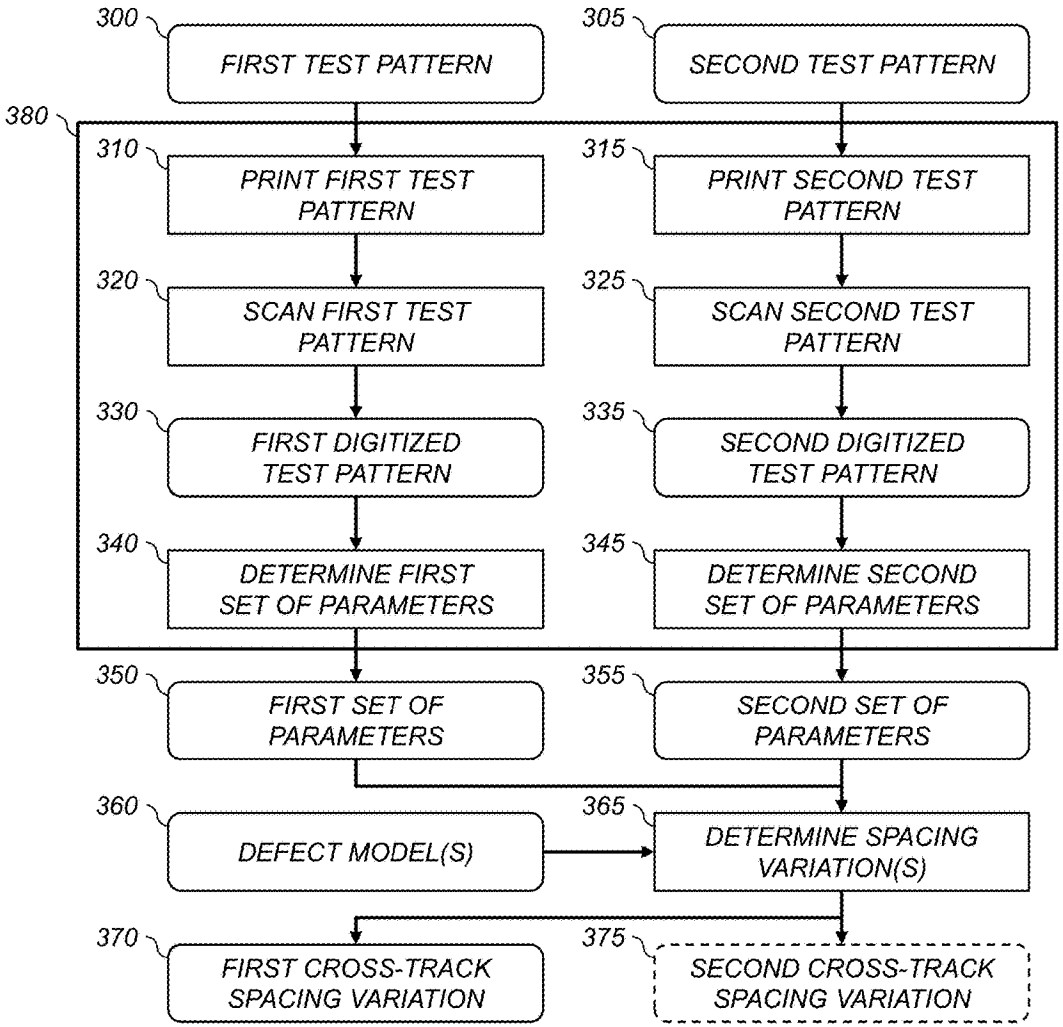
FIG. 3 is a flow chart of a method for determining estimated cross-track spacing variations in accordance with an exemplary embodiment.

Returning to a discussion of FIG. 3, a print first test pattern step 310 is used to print the first test pattern 300 using the electrophotographic printing system. A scan first test pattern step 320 is the used to capture an image of the printed first test pattern to provide a first digitized test pattern 330. In an exemplary embodiment, the scan first test pattern step 320 captures the image of the printed first test pattern using an image capture system (e.g., an image scanning system such as a flatbed scanner). In other embodiments, the scan first test pattern step 320 can use other types of image captures systems such as a digital camera system. In an exemplary embodiment, the image capture system digitizes the printed first test pattern at a spatial resolution of 600 dpi. However, in other embodiments other resolutions can be used. Preferably the spatial resolution should be in the range of 50-2400 dpi to adequately resolve the test pattern characteristics.

Similarly, the second test pattern 305 is printed using a print second test pattern step 315 to provide a printed second test pattern. A scan second test pattern step 325 is then used to capture an image of the printed second test pattern to provide a second digitized test pattern 335. In an exemplary embodiment, the printed second test pattern is digitized at 1200 dpi, which is a higher resolution than was used for the first digitized test pattern 330. This is to enable the line width of the printed lines in the line pattern to be characterized.

In some embodiments, various image processing operations can be the first and second digitized test patterns 330, 335. For example, an alignment process can be used to remove any skew in the scanned image. (Here the tern skew refers to a misalignment between the orientation of the patches and the scan lines in the digitized image. The optional fiducial marks 304 can be used to assist in the alignment process. In a preferred configuration, the scanner code values are inverted so that dark image values correspond to higher code values, and the code value corresponding to the paper is subtracted so that the code values will be a representation of the optical density of the toner in the printed image.

A determine first set of parameters step 340 is now used to analyze the first digitized test pattern 330 to determine a first set of parameters 350 which characterize an attribute of the printed first test pattern as a function of cross-track position. Likewise, a determine second set of parameters step 350 is used to analyze the second digitized test pattern 335 to determine a second set of parameters 355 which characterize an attribute of the printed second test pattern as a function of cross-track position. The first and second sets of parameters 350, 355 can each have one or more parameters.

The attributes of the printed first and second test patterns that are characterized by the first and second sets of parameters 350, 355 can be the same or can be different. In an exemplary configuration, the attribute of the printed first test patterns which is characterized by the first sets of parameters 350 is the cross-track density non-uniformities in the printed test patterns, and the attribute of the printed second test patterns which is characterized by the second sets of parameters 355 is the cross-track variations of the line densities in the printed test patterns. In other embodiments, first and second sets of parameters 350, 355 can characterize other types of image attributes that are found to vary with cross-track spacing variations of the printer components. Such attributes could include density uniformity attributes, spatial noise attributes, and image sharpness attributes.

In an exemplary embodiment, an aggregate cross-track profile is determined combining the cross-track profiles for the various regions in the corresponding test patterns. In some embodiments, the first and second sets of parameters 350, 355 each have a single parameter which characterizes an average slope of the aggregate cross-track profile.

Figure 6:
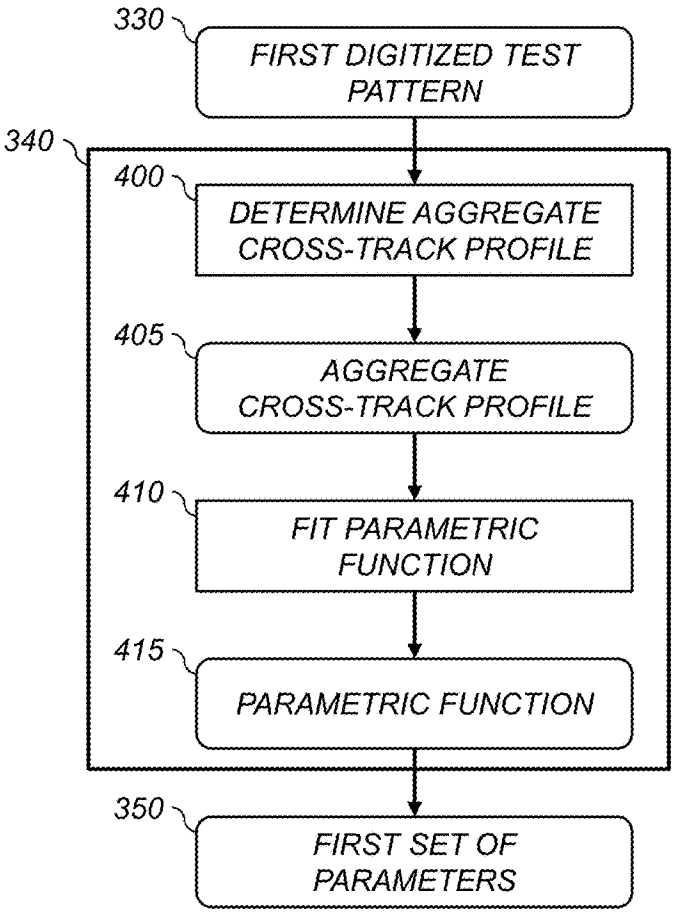
FIG. 6 is a flow chart showing additional details of the determine first set of parameters step in FIG. 3.

Additional details of the determine first set of parameters step 340 which is used to process the first digitized test pattern 330 to determine the first set of parameters 350 are shown in FIG. 6 according to an exemplary embodiment.

A determine aggregate cross-track profile step 400 is first used to analyze the first digitized test pattern 330 to determine an aggregate cross-track profile 405. Additional details of this step according to an exemplary embodiment which uses a singular value decomposition approach are shown in FIG. 7.

Figure 7:
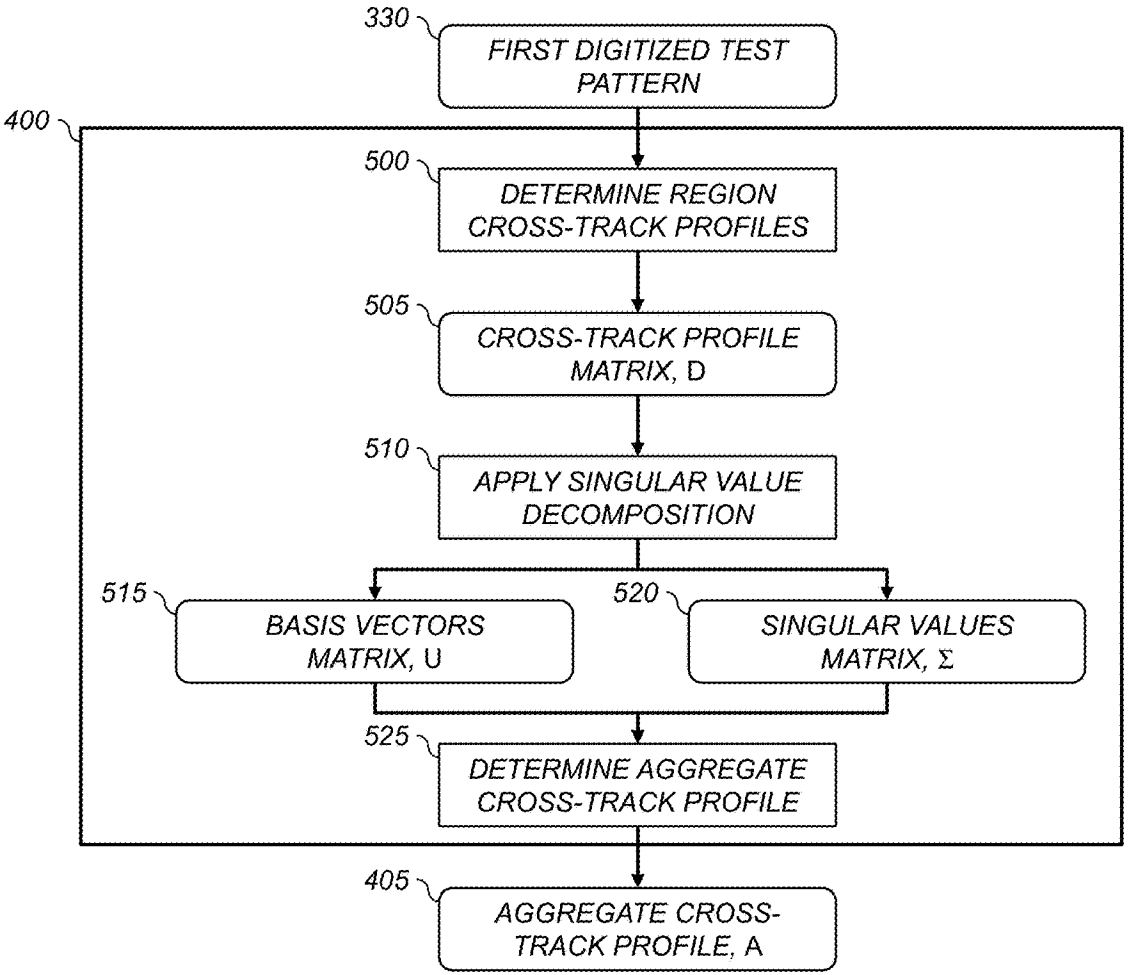
FIG. 7 is a flow chart showing additional details of the determine aggregate cross-track profile step in FIG. 6.

As shown in FIG. 7, a determine region cross-track profiles step 500 is first used to determine a cross-track profile for each of the regions 302*a*-302*g* in the first test pattern 300 (FIG. 4). For the first digitized test pattern 330, the region cross-track profile represents the image density as a function of the cross-track position. In some cases, the region cross-track profile can be represented in terms of the well-known optical density value. In other cases, the region cross-track profile can be represented in terms of some other quantity (e.g., scanner code values) that have a known relationship to the image density. The cross-track position can be represented by a value n, where n=1 to N, N being the number of cross-track positions that are sampled in the first digitized test pattern 330. In an exemplary embodiment, the pixel values of the pixels in the first digitized test pattern 330 corresponding to each cross-track position within one of the regions are averaged to provide an N×1 vector representing the region cross-track profile.

Figure 8:
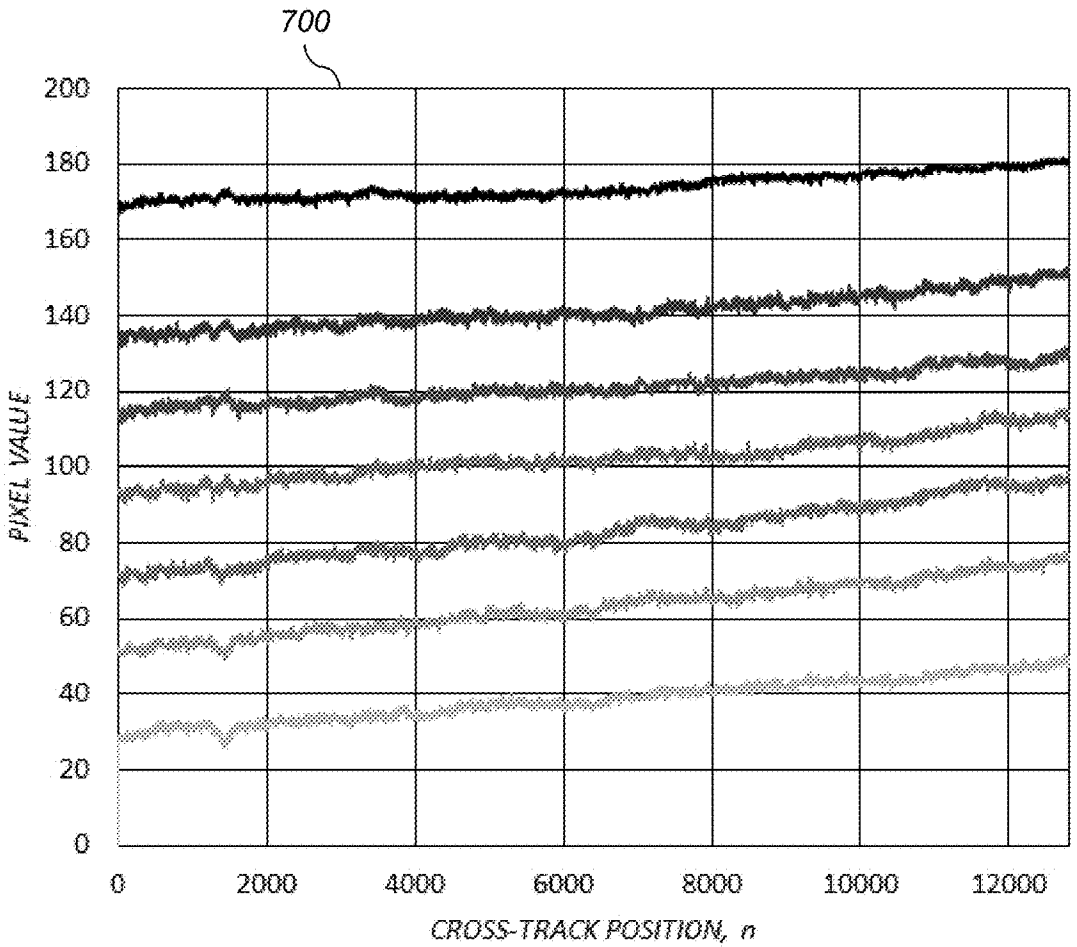
FIG. 8 is a graph showing an exemplary set of region cross-track profiles.

FIG. 8 shows a graph 700 showing a set of exemplary region cross-track profiles for each of the regions in the first test pattern 300 (FIG. 4). The pixel values of the vertical axis in this example are inverse scanner code values. It can be seen that the region cross-track profiles exhibit a side-to-side non-uniformity as a result of a cross-track spacing variation (which in this case included a +500 μm cross-track spacing variation in the charging subsystem 210 and a +26 μm cross-track spacing variation the development subsystem 225.

Generally, the determine second set of parameters step 345 will use an analogous set of steps to process the second digitized test pattern 335 to determine the second set of parameters 355. However, the determine region cross-track profiles step 500 can characterize the cross-track performance using a different image attribute. For example, rather than determining an average density value at each cross-track position, an average line width or average line density can be determined at each cross-track position for the lines in the region test patterns 305*a*-305*g* (FIG. 5). In a preferred embodiment, the cross-sections through the lines at a particular cross-track position are overlaid and averaged to determine an average line profile. A line density (i.e., the amplitude of the line) or a line width (i.e., the width of the line at a certain density) is then determined from the average line profile. In one embodiment, a reference line profile is determined that takes into account the scanner modulation transfer function (MTF), and a scale factor is determined for scaling the reference profile that provides a best fit to the average line profile. The scale factor will then serve as a measure of the line density/line width. In this case, the region cross-track profiles are represented by the scale factor as a function of cross-track position.

Continuing with a discussion of FIG. 7, the region cross-track profiles for each of the M regions 302*a*-302*g* are merged into a single N×M cross-track profile matrix (D) 505, where each column corresponds to the region cross-track profile for a particular region:

$$D = \begin{bmatrix} D_{1,1} & \Lambda & D_{1,m} & \Lambda & D_{1,M} \\ M & & M & & M \\ Dn,1 & \Lambda & D_{n,m} & \Lambda & D_{n,M} \\ M & & M & & M \\ D_{N,1} & \Lambda & D_{N,m} & \Lambda & D_{N,M} \end{bmatrix} \quad (1)$$

where $D_{n,m}$ is the averaged pixel value for a cross-track position n in region m.

An apply singular value decomposition step 510 can be used to apply the well-known mathematical technique known as singular value decomposition to factor the cross-track profile matrix 505 into its orthogonal components:

$$D=U\Sigma V^T \quad (2)$$

where U is an N×N basis vectors matrix 515 where the columns form a set of basis vectors, E is an N×M diagonal singular values matrix 520 containing the singular values of D, and $V^T$ is an M×M matrix where the columns form another set of basis vectors orthogonal to those of the U.

A determine aggregate cross-track profile step 525 is then used to determine the aggregate cross-track profile 405 responsive to the basis vectors matrix 515 and the singular values matrix 520. In an exemplary embodiment, the aggregate cross-track profile 405 is an N×1 column vector which is set equal to the first basis vector corresponding to the first column of the basis vectors matrix 515 (U) scaled by the first singular value ($\Sigma_{1,1}$).

Figure 9:
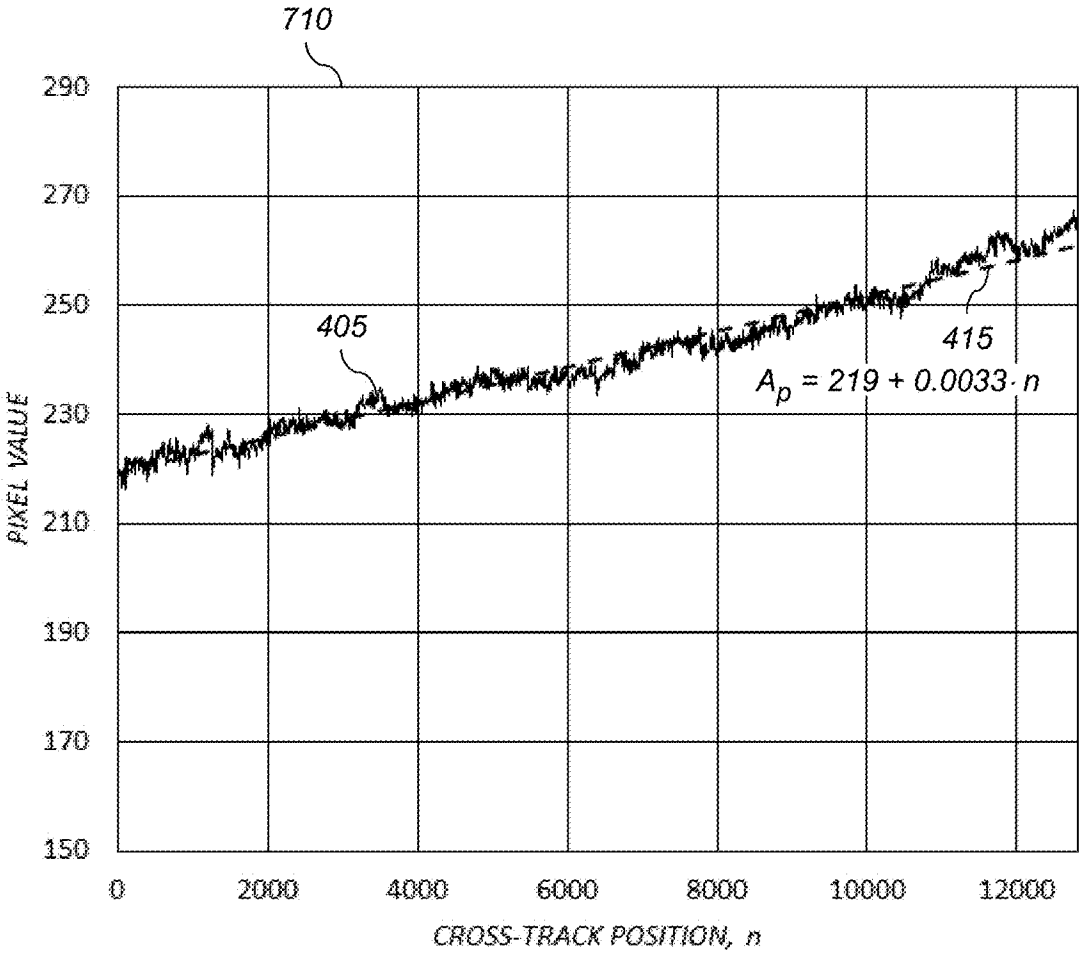
FIG. 9 is a graph showing an exemplary aggregate cross-track profile.

FIG. 9 shows a graph 710 illustrating an exemplary aggregate cross-track profile 405 determined from the region cross-track profiles of FIG. 8. It can be seen that the aggregate cross-track profile 405 exhibits a trend that is similar to that of the region cross-track profiles of FIG. 8.

It will be obvious to one skilled in the art that in other embodiments the determine aggregate cross-track profile step 400 can determine the aggregate cross-track profile 405 using any other method known in the art. For example, an aggregate cross-track profile 405 can be determined by forming a weighted sum of a plurality of the basis vectors, or by taking the inner product of the basis vectors matrix 515 and the singular values matrix 520 to form an N×1 column vector. In other embodiments, the cross-track profiles for each region can be shifted to have a mean value of zero, and then the shifted cross-track profiles can be averaged to characterize the average profile shape. In general, any method for determining an aggregate cross-track profile 405 that adequately characterizes the response variations associated with the cross-track spacing variations can be used in accordance with the invention.

Returning to a discussion of FIG. 6, a fit parametric function step 410 is used to fit a parametric function 415 to the aggregate cross-track profile 405 to determine the first set of parameters 350. In an exemplary embodiment, a least-squares fitting process is used fit a linear function to the aggregate cross-track profile 405. This step is repeated for each of the test patterns to give linear parametric functions 415 of the form:

$$A_p=\alpha_p+\beta_p \cdot n \tag{3}$$

where p is the test pattern number, $\alpha_p$ is an intercept parameter, and $\beta_p$ is a slope parameter. In the example shown in FIG. 3, there are two test patterns so that the first test pattern 300 will correspond to p=1 and the second test pattern 305 will correspond to p=2. FIG. 9 shows the parametric function 415 determined for the illustrated aggregate cross-track profile 405.

In an exemplary embodiment, the slope parameter $\beta_p$ determined for each test pattern is used as the corresponding set of parameters. In this case, the first set of parameters 350 is given by the slope parameter $\beta_1$ determined for the first test pattern 300, and the second set of parameters 355 is given by the slope parameter $\beta_2$ determined for the second test pattern 305. In other embodiments, each set of parameters can include more than one parameter (e.g., slope and intercept, or coefficients for higher order polynomial functions).

As illustrated in FIG. 3, it can be useful to group the steps involved in determining the first and second sets of parameters 350, 355 into a determine parameter sets process 380. This will enable the simplification of FIG. 12 which will be discussed below.

Figure 10:
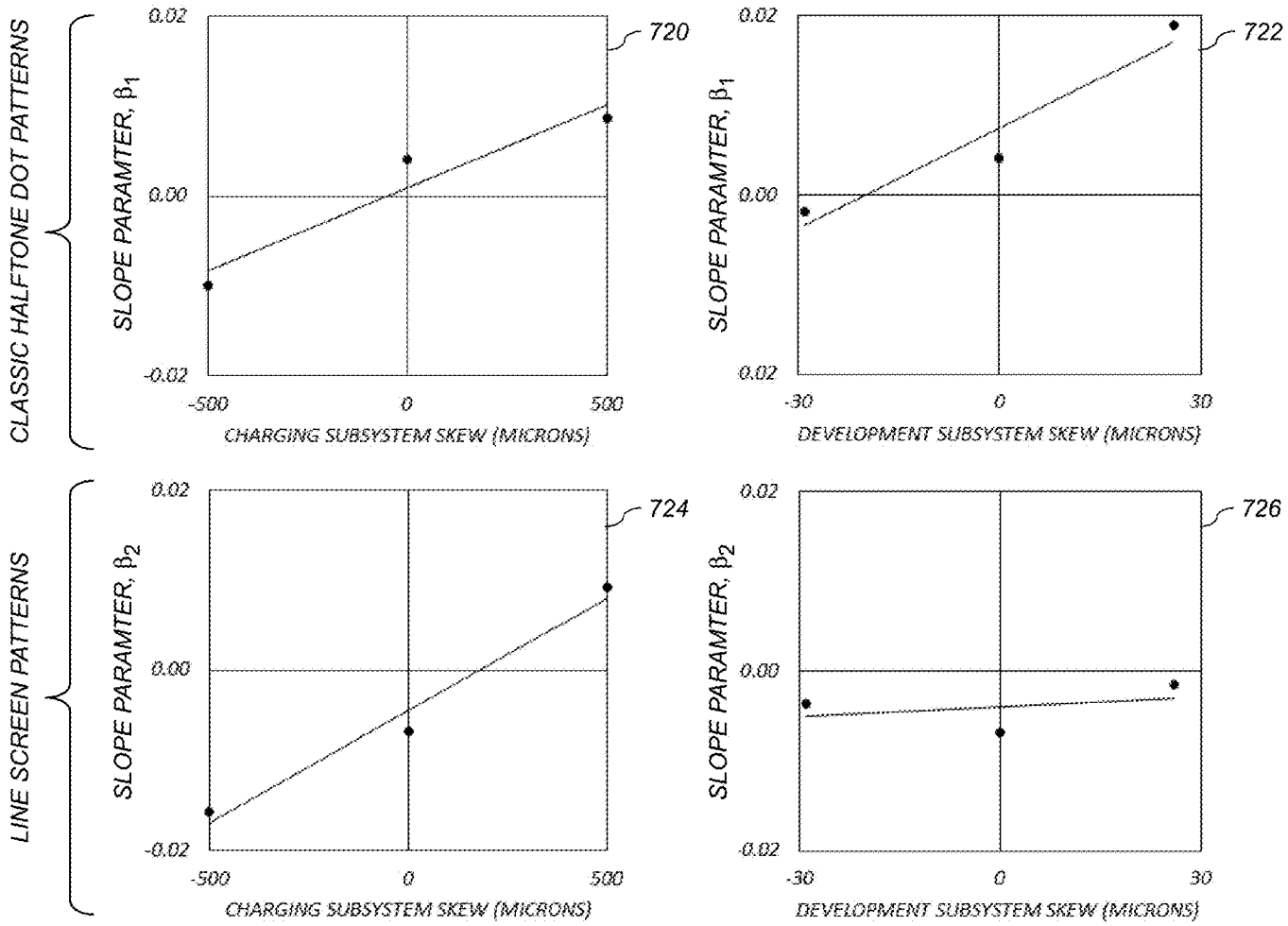
FIG. 10 is a set of graphs illustrating the relationship between the slope parameters determined from the test patterns in FIGS. 4 and 5 as a function of subsystem skew.

The method of the present invention relies on the observation that different test patterns respond differently to skew (i.e., cross-track spacing variations) in different printer subsystems. This is illustrated in FIG. 10 which shows graphs 720, 722, 724, 726 illustrating the slope parameter determined for the test patterns of FIGS. 4 and 5 as a function of skew in the charging subsystem 210 and the development subsystem 225 (FIG. 2). It can be seen that the slope parameter determined for the classic halftone dot patterns of the first test pattern 300 (FIG. 4) is sensitive to skew in both the charging subsystem 210 and the development subsystem 225. On the other hand, the slope parameter determined for the line screen patterns of the second test pattern 305 (FIG. 5) varies with different amounts of skew in the charging subsystem 210, but is relatively insensitive to skew in the development subsystem 225. As a result, determining the slope parameters for both the first and second test patterns 300, 305 enables the amount of both types of skew to be estimated. This is embodied by the determine spacing variation(s) step 365 of FIG. 3 which uses one or more defect model(s) 360 to estimate one or more types of cross-track spacing variation. For example, a first defect model 360 can be used to estimate a first cross-track spacing variation 370 for a first printer subsystem (e.g., the charging subsystem 210), and optionally a second defect model 360 can be used to estimate a second cross-track spacing variation 375 for a second printer subsystem (e.g., the development subsystem 225).

In an exemplary embodiment, a defect model 360 is provided for each type of skew which predicts the amount of skew $S_i$ (i.e., the amount of cross-track spacing variation) for the $i^{th}$ printer subsystem as a function of the first set of parameters 350 (i.e., slope parameter $\beta_1$) and the second set of parameters 355 (i.e., slope parameter $\beta_2$):

$$S_i=f_i(\beta_1,\beta_2) \tag{4}$$

where $f_i(\cdot)$ is the defect model 360 for the $i^{th}$ type of skew. In an exemplary configuration, i=1 corresponds to a cross-track spacing variation in the charging subsystem 210 (FIG. 2) and i=2 corresponds to a cross-track spacing variation in the development subsystem 225 (FIG. 2), and the defect model 360 is a linear model of the form:

$$S_i=b_{0i}+b_{1i}\cdot\beta_1+b_{2i}\cdot\beta_2 \tag{5}$$

where $b\beta_{0i}$, $b_{1i}$ and $b_{2i}$ are experimentally determined parameters.

Figure 11:
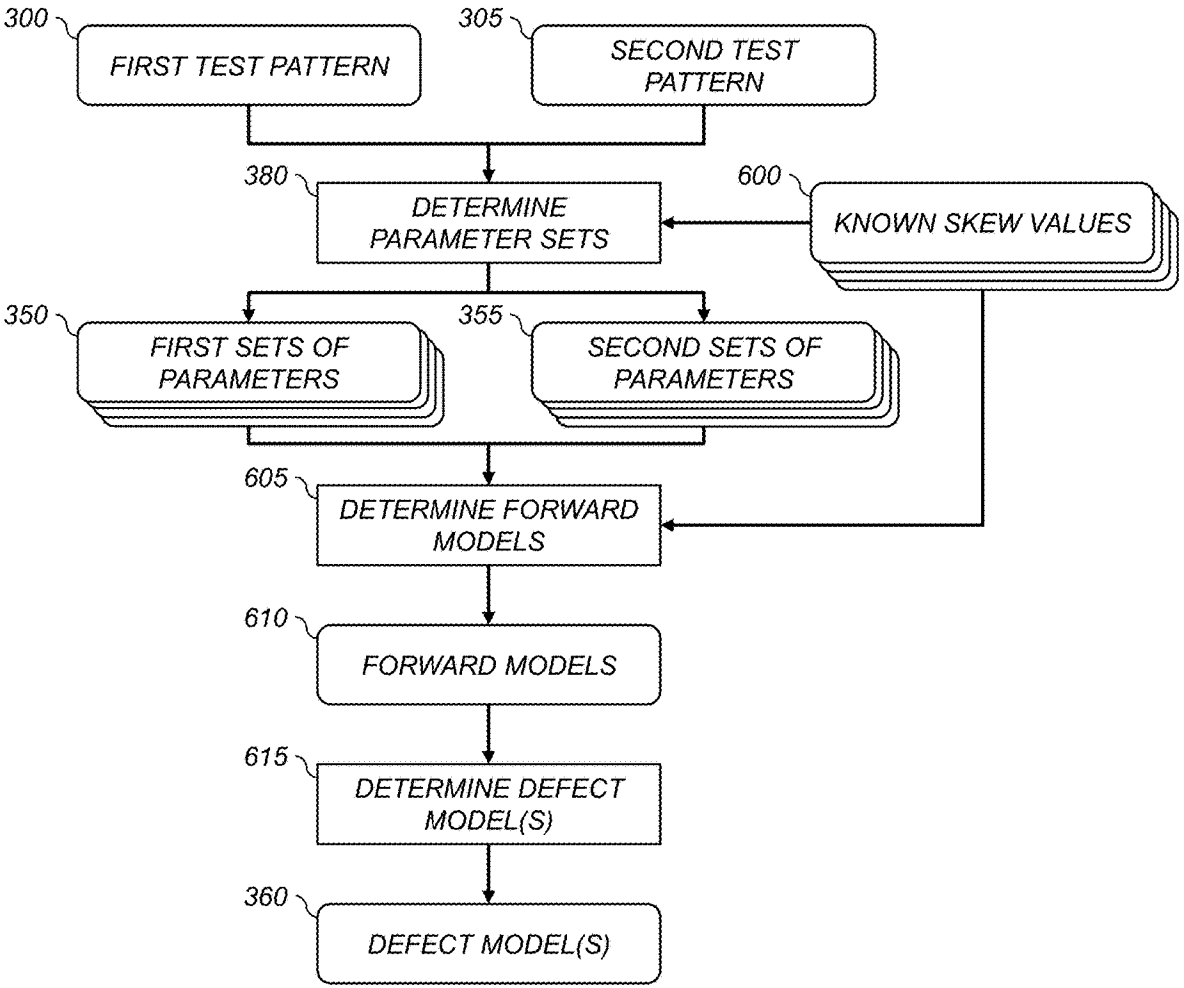
FIGS. 11 and 12 are flow charts of method for determining defect models in accordance with exemplary embodiments.

FIG. 11 shows an exemplary experimental process that can be used to determine defect model(s) 360 for estimating the amount of cross-track spacing variation for one or more printer subsystems. The method involves adjusting the skew values for a set of printer subsystems to a set of known skew values 600, and then applying the determine parameter sets step 380 to determine corresponding first and second sets of parameters 350, 355 for each of the known skew value settings. For example, the known skew values 600 can include nine skew value settings with a 3×3 matrix of skew variations (three different skew variations for the charging subsystem 210 and three different skew variations for the development subsystem 225).

A determine forward models step is used to determine a forward model 610 that predicts each of the parameters in the first and second sets of parameters 350, 355 as a function of the skew values. In an exemplary embodiment, a linear model is fit to the measured data of the form:

$$\beta_p=a_{0p}+a_{1p}\cdot S_1+a_{2p}\cdot S_2 \tag{6}$$

where $S_1$ is the known skew value for a first printer subsystem (e.g., the charging subsystem 210), $S_2$ is the known skew value for a second printer subsystem (e.g., the development subsystem 225), and $\beta_p$ is the predicted slope parameter in the corresponding sets of parameters (i.e., $\beta_1$ is the slope parameter for the first set of parameters 350 corresponding to the classic halftone dot patterns and $\beta_2$ is the slope parameter for the second set of parameters 355 corresponding to the line screen patterns). In an exemplary embodiment, the following forward models 610 were determined:

$$\beta_1=0.00532+(1.94\times10^{-5})\cdot S_1+(3.66\times10^{-4})\cdot S_2 \quad (7a)$$

$$\beta_2=-0.002+(2.14\times10^{-5})\cdot S_1+(1.21\times10^{-5})\cdot S_2 \quad (7b)$$

where $S_1$ is the skew (i.e., cross-track spacing variation) of the charging subsystem 210 (in microns) and $S_2$ is the skew of the development subsystem 225 (in microns). The model fits for the forward models 610 were very good, with the $R^2$ correlation coefficients being 0.88 for the $\beta_1$ slope coefficient model, and 0.91 for the $\beta_2$ slope coefficient model.

A determine defect model(s) step 615 is used to determine defect model(s) 360 for one or more printer subsystems 360 responsive to the determined forward models 610. In an exemplary embodiment, the determine defect model(s) step 615 determines the defect model(s) 360 by taking the set of equations for the forward models 610 and using conventional equation solving techniques to solve for the skew values as a function of the parameter values as in Eq. (5). For the case of the forward models of Eqs. (7a)-(7b), the following defect models 360 were determined:

$$S_1=105-1593\cdot\beta_1+48173\cdot\beta_2 \quad (8a)$$

$$S_2=-20.1+2817\cdot\beta_1-2553\cdot\beta_2 \quad (8b)$$

The forward models 610 and defect models 360 that have been described with reference to an exemplary embodiment have been simple linear models. It will be obvious to one skilled in the art that other types of models could also be used including polynomial, exponential and logarithmic models. The form of the model that is most appropriate for a particular application can be determined based on evaluating the experimental data using standard data modeling techniques. Depending on the form of the forward models 610 it may not be possible to determine defect models 360 by simply solving the equations defining the forward models 610 for the skew levels. In such cases, it may be necessary to use some other type of mathematical inversion process.

Figure 12:
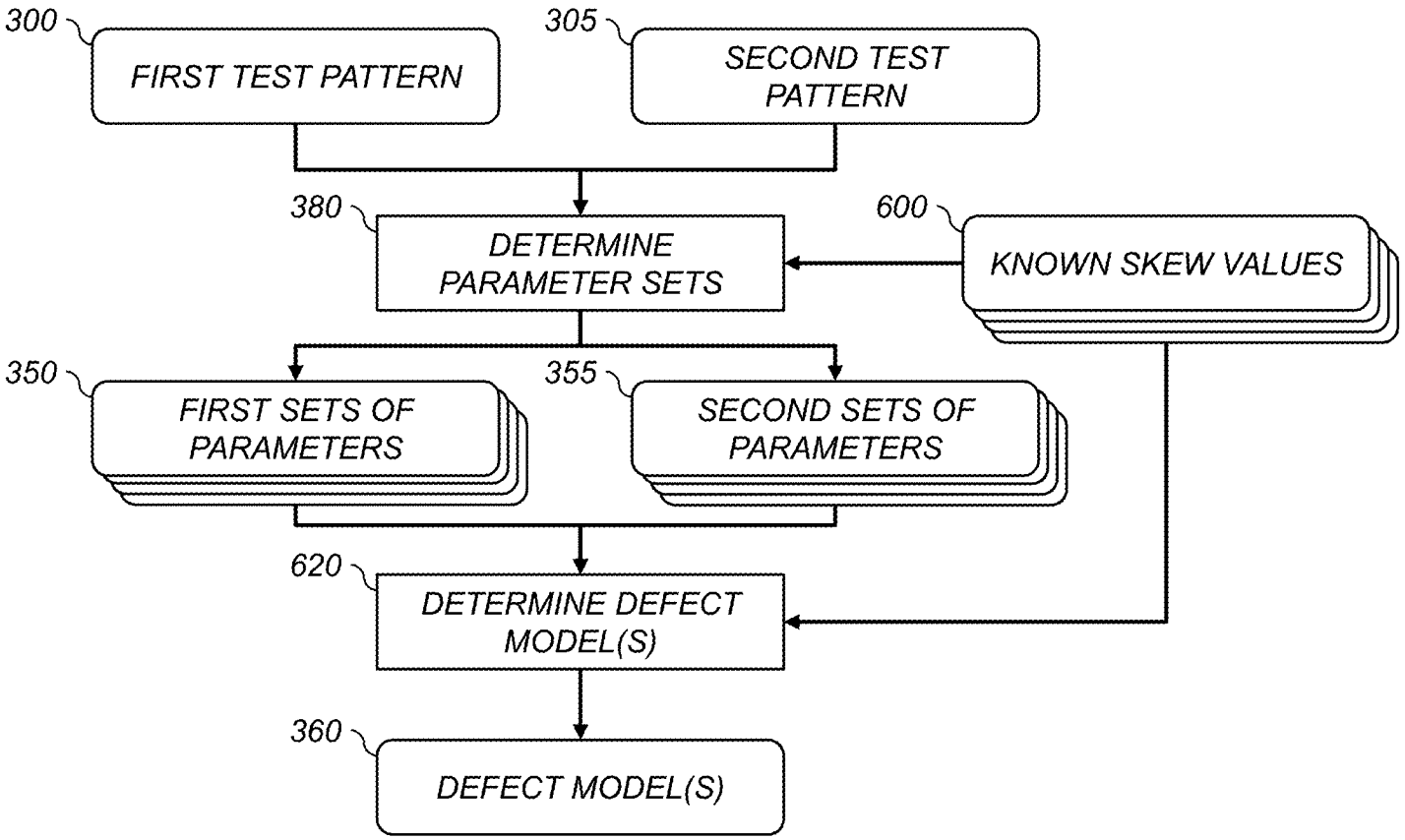

While the method of FIG. 11 shows the formation of forward models 610 as an intermediate step in the determination of the defect model(s) 360, one skilled in the art will be recognize that the defect models could alternatively be determined directly by fitting appropriate mathematical functions to the experimental data that will predict the known skew values 600 as a function of the first and second sets of parameters 350, 355. For example, linear mathematical functions of the form shown in Eq. (5) can be fit directly to the experimental data. With this approach it is not necessary to perform a separate inversion step to determine the defect models 360. This approach is illustrated in FIG. 12, where the determine forward models step 605 and determine defect model(s) step 620 of FIG. 11 have been replaced by a single determine defect model(s) step 620. Using this approach, slightly different defect models 360 are determined compared to those determined above using the method of FIG. 11:

$$S_1=92.6-1153\cdot\beta_1+43684\cdot\beta_2 \quad (9a)$$

$$S_2=-17+2382\cdot\beta_1-2150\cdot\beta_2 \quad (9b)$$

However, the difference between the predictions of the two sets of defect models 360 are not statistically different. The model fits for the defect models 360 were very good, with the $R^2$ correlation coefficients being 0.91 for the $S_1$ defect model, and 0.85 for the $S_2$ defect model.

While the method of FIG. 3 shows determining sets of parameters for two test patterns (i.e., first and second test patterns 300, 305), it will be recognized by one skilled in the art that the method of can easily be generalized to include more than two test patterns or different types of test patterns. For example, one or more additional sets of test patterns can be printed, scanned and analyzed to determine one or more additional sets of parameters. The additional parameters can be used to provide additional inputs to the defect models 360. The method can also be generalized to determine cross-track spacing variations for more than two printer subsystems. In general, the number of parameters that are input into the defect models 360 should be at least as large as the number of printer subsystems that are sensitive to cross-track spacing variations, where the functional relationship between a parameter $\beta_p$ and the cross-track spacing variations $S_i$ for a given pattern p should preferably not be a linear combination of any of the other functional relationships for the other parameters (i.e., the relationships need to be linearly independent in order to have a unique solution for the inverse model.)

Once the cross-track spacing variations 370, 375 have been determined by the determine spacing variation(s) step 365 of FIG. 3, there are a variety of actions that can optionally be taken in various embodiments. In some embodiments, the determined cross-track spacing variations 370, 375 are compared to predefined thresholds to determine whether the cross-track spacing variations 370, 375 are significant, and if one of the cross-track spacing variations 370, 375 exceeds the threshold an appropriate corrective action can be taken. Generally, the corrective action will involve adjusting a position of an element of the corresponding printer subsystem in order to provide a reduced cross-track spacing variation. For example, if it is determined that there is an estimated cross-track spacing variation of a certain size for the charging subsystem 210 (FIG. 2), then a spacing between the charging subsystem 210 and the photoreceptor 206 can be adjusted at one or both of the cross-track ends of the charging subsystem 210.

In some embodiments, when a significant cross-track spacing variation is detected, a message can be provided to a system operator to alert them that an appropriate correction is required. The message can include a recommended adjustment magnitude that will compensate for the estimated cross-track spacing variations 370, 375. For example, the system operator can be instructed to change turn a knob that controls the cross-track spacing of the relevant printer subsystem to a specified position.

In some embodiments, the printing module 31 (FIG. 2) may include automated mechanisms (for example, a computer-controlled motor) for adjusting the cross-track spacing of the relevant printer subsystems. In such cases, the logic and control unit 99 can send appropriate control signals to the automated mechanisms to make appropriate adjustments to the cross-track spacing of the relevant printer subsystems.

The method of the present invention is preferably performed during the system manufacturing process to assess and correct any cross-track spacing variations in the relevant subsystems. It can also be conveniently performed in the field by a system operator. The method can be performed at predefined service intervals, or can be initiated when the system operator observes a problem in the printed images (e.g., cross-track density non-uniformities).

The invention has been described in detail with particular reference to certain preferred embodiments thereof, but it will be understood that variations, combinations, and modifications can be effected by a person of ordinary skill in the art within the spirit and scope of the invention.

PARTS LIST

31 printing module
32 printing module
33 printing module
34 printing module
35 printing module
38 print image
39 fused image
40 supply unit
42 receiver
42*a* receiver
42*b* receiver
50 transfer subsystem
60 fuser module
62 fusing roller
64 pressure roller
66 fusing nip
68 release fluid application substation
69 output tray
70 finisher
81 transport web
86 cleaning station
99 logic and control unit (LCU)
100 printer
111 imaging member
112 intermediate transfer member
113 transfer backup member
201 first transfer nip
202 second transfer nip
206 photoreceptor
210 charging subsystem
211 meter
212 meter
213 wires
216 surface
220 exposure subsystem
225 development subsystem
226 toning shell
227 magnetic core
240 power source
290 cross-track direction
295 in-track direction
300 first test pattern
300*a* region test pattern
300*b* region test pattern
300*c* region test pattern
300*d* region test pattern
300*e* region test pattern
300*f* region test pattern
300*g* region test pattern
302*a* region
302*b* region
302*c* region
302*d* region
302*e* region
302*f* region
302*g* region
304 fiducial mark
305 second test pattern
305*a* region test pattern
305*b* region test pattern
305*c* region test pattern
305*d* region test pattern
305*e* region test pattern
305*f* region test pattern
305*g* region test pattern
307*a* region
307*b* region
307*c* region
307*d* region
307*e* region
307*f* region
307*g* region
310 print first test pattern step
315 print second test pattern step
320 scan first test pattern step
325 scan second test pattern step
330 first digitized test pattern
335 second digitized test pattern
340 determine first set of parameters step
345 determine second set of parameters step
350 first set of parameters
355 second set of parameters
360 defect model(s)
365 determine spacing variation(s) step
370 first cross-track spacing variation
375 second cross-track spacing variation
380 determine parameter sets process
400 determine aggregate cross-track profile step
405 aggregate cross-track profile
410 fit parametric function step
415 parametric function
500 determine region cross-track profiles step
505 cross-track profile matrix
510 apply singular value decomposition step
515 basis vectors matrix
520 singular values matrix
525 determine aggregate cross-track profile step
600 known skew values
605 determine forward models step
610 forward models
615 determine defect model(s) step
620 determine defect model(s) step
700 graph
710 graph
720 graph
722 graph
724 graph
726 graph

The invention claimed is:

1. A method for characterizing cross-track spacing variations for a plurality of printer subsystems of an electrophotographic printing system, comprising:

printing a first test pattern;

printing a second test pattern;

capturing an image of the printed first test pattern to provide a first digitized test pattern including a first array of pixel values;

capturing an image of the printed second test pattern to provide a second digitized test pattern including a second array of pixel values;

analyzing the first digitized test pattern to determine a first set of parameters that characterize an attribute of the printed first test pattern as a function of cross-track position;

analyzing the second digitized test pattern to determine a second set of parameters that characterize an attribute of the printed second test pattern as a function of cross-track position; and using a first defect model to determine an estimated first cross-track spacing variation for a first printer subsystem as a function of the determined first set of parameters and the determined second set of parameters;

wherein the first defect model is determined by:

printing the first and second test patterns at a set of known cross-track spacing variation levels;

determining the first and second sets of parameters for each of the known cross-track spacing variation levels; and determining a first mathematical function that defines the first defect model responsive to the known cross-track spacing variation levels and the determined first and second sets of parameters, wherein the first mathematical function predicts the first cross-track spacing variation level for the first printer subsystem as a function of the first and second sets of parameters.

2. The method of claim 1, further including adjusting an element of the first printer subsystem responsive to the estimated first cross-track spacing variation to provide a reduced cross-track spacing variation if the estimated first cross-track spacing variation is larger than a first predefined threshold.

3. The method of claim 1, wherein the first cross-track spacing variation corresponds to a variation in a spacing between an element of the first printer subsystem and an image receiving element as a function of cross-track position.

4. The method of claim 1, wherein the first test pattern includes a pattern of dots and the second test pattern includes a pattern of lines.

5. The method of claim 4, wherein the pattern of dots includes a plurality of regions, the dots in each region having a different dot size.

6. The method of claim 5, wherein the dots in each region are produced using different pixel exposure levels.

7. The method of claim 4, wherein the pattern of lines includes a plurality of regions, each region having a different line width.

8. The method of claim 7, wherein the lines in each region are produced using different pixel exposure levels.

9. The method of claim 1, wherein analyzing the second digitized test pattern includes:

determining a second linear function representing a trend of the pixel values of the second digitized test pattern as a function of cross-track position; and wherein a parameter in the second set of parameters corresponds to a slope of the second linear function.

10. The method of claim 1, further including:

printing one or more additional test patterns;

capturing images of the one or more printed additional test patterns to provide one or more additional digitized test pattern;

analyzing the one or more additional digitized test patterns to determine one or more additional sets of parameters that characterize an attribute of the printed one or more additional test patterns as a function of cross-track position;

wherein the first defect model is also a function of the determined one or more additional sets of parameters.

11. A method for characterizing cross-track spacing variations for a plurality of printer subsystems of an electrophotographic printing system, comprising:

printing a first test pattern;

printing a second test pattern;

capturing an image of the printed first test pattern to provide a first digitized test pattern including a first array of pixel values;

capturing an image of the printed second test pattern to provide a second digitized test pattern including a second array of pixel values;

analyzing the first digitized test pattern to determine a first set of parameters that characterize an attribute of the printed first test pattern as a function of cross-track position;

analyzing the second digitized test pattern to determine a second set of parameters that characterize an attribute of the printed second test pattern as a function of cross-track position;

using a first defect model to determine an estimated first cross-track spacing variation for a first printer subsystem as a function of the determined first set of parameters and the determined second set of parameters; and using a second defect model to determine an estimated second cross-track spacing variation for a second printer subsystem as a function of the determined first set of parameters and the determined second set of parameters.

12. The method of claim 11, further including determining the second defect model by:

printing the first and second test patterns at a set of known cross-track spacing variation levels;

determining the first and second sets of parameters for each of the known cross-track spacing variation levels; and determining a second mathematical function that defines the second defect model responsive to the known cross-track spacing variation levels and the determined first and second sets of parameters, wherein the second mathematical function predicts the second cross-track spacing variation level for the second printer subsystem as a function of the first and second sets of parameters.

13. The method of claim 11, further including adjusting an element of the second printer subsystem responsive to the estimated second cross-track spacing variation to provide a reduced cross-track spacing variation if the estimated second cross-track spacing variation is larger than a second predefined threshold.

14. The method of claim 11, wherein the second cross-track spacing variation corresponds to a difference in a spacing between an element of the second printer subsystem and an image receiving element as a function of cross-track position.

15. The method of claim 11, wherein the first printer subsystem is a charging subsystem and the second printer subsystem is a toner development subsystem.

16. A method for characterizing cross-track spacing variations for a plurality of printer subsystems of an electrophotographic printing system, comprising:

printing a first test pattern;

printing a second test pattern;

capturing an image of the printed first test pattern to provide a first digitized test pattern including a first array of pixel values;

capturing an image of the printed second test pattern to provide a second digitized test pattern including a second array of pixel values;

analyzing the first digitized test pattern to determine a first set of parameters that characterize an attribute of the printed first test pattern as a function of cross-track position;

analyzing the second digitized test pattern to determine a second set of parameters that characterize an attribute of the printed second test pattern as a function of cross-track position; and using a first defect model to determine an estimated first cross-track spacing variation for a first printer subsystem as a function of the determined first set;

wherein analyzing the first digitized test pattern includes determining a first linear function representing a trend of the pixel values of the first digitized test pattern as a function of cross-track position;

and wherein a parameter in the first set of parameters corresponds to a slope of the first linear function.

17. The method of claim 16, wherein determining the first linear function includes:

determining region cross-track profiles for a plurality of image regions in the first digitized test pattern, each image region having a different associated tone level, wherein the region cross-track profiles represent an attribute of the first digitized test pattern as a function of cross-track position;

combining the region cross-track profiles to determine an aggregate cross-track profile; and fitting a linear function to the aggregate cross-track profile to provide the first linear function.

18. The method of claim 17, wherein the attribute of the first digitized test pattern is an average image density, an average line density, or an average line width.

19. The method of claim 17, wherein combining the region cross-track profiles includes applying a singular value decomposition algorithm to the region cross-track profiles.

* * * * *